US005934673A

United States Patent [19]

Telarico et al.

[11] Patent Number: 5,934,673

[45] Date of Patent: Aug. 10, 1999

[54] AUTO RACING (BOARD GAME)

[76] Inventors: Mark Thomas Telarico; Lea Kimberly Telarico, both of 2440 P.S. Holden Rd., Greensboro, N.C. 27407

[21] Appl. No.: 08/863,112

[22] Filed: May 27, 1997

[51] Int. Cl.[6] ..... A63F 3/00

[52] U.S. Cl. ..... 273/246

[58] Field of Search ..... 273/236, 242, 273/243, 246, 248, 249

[56] References Cited

U.S. PATENT DOCUMENTS

| | | | |
|---|---|---|---|
| 3,883,143 | 5/1975 | Kelley et al. | 273/246 |
| 4,199,147 | 4/1980 | Stansberry | 273/246 X |
| 5,350,178 | 9/1994 | Hollar | 273/246 |
| 5,398,941 | 3/1995 | Paulson | 273/246 X |
| 5,560,609 | 10/1996 | Grant | 273/246 |
| 5,662,325 | 9/1997 | Weyand | 273/246 X |

*Primary Examiner*—William E. Stoll
*Attorney, Agent, or Firm*—Mills Law Firm PLLC

[57] ABSTRACT

An improved automobile racing board game including a game board having a race track thereon comprising a plurality of contiguous lanes with a start/finish line and winner's circle is disclosed. Player game pieces resembling racing cars are provided for marking each player's position on the track during play. At least one score chart is provided for recording the number of laps completed by each player during the game. Players select game pieces as desired and the order of play is established by drawing from a plurality of qualifying cards having speed indicia thereon with the player having the highest speed receiving the "pole position" at the starting line inside lane. Play alternates among the players with the quantity of each move being determined by chance including standard dice and another supplemental die. The supplemental chance die provides some advantage or set back to the player who opts to utilize it. Players can move their game pieces laterally to an adjacent lane in an effort to achieve an advantage or block an opponent. Play continues until a predetermined number of laps have been completed to declare a winner of a given race. Play continues until all players have crossed the finish line and a point value is assigned to their respective finishing positions. A racing schedule of a plurality of racing events is provided and the players accumulate an overall point total to determine their standing in a simulated racing season.

5 Claims, 6 Drawing Sheets

36 40

| ·RACE SCHEDULE· | Laps | ·POINTS· | |
|---|---|---|---|
| ROLLING THUNDER | 20 | FIRST → | 80 |
| GEAR GRINDER | 15 | SECOND → | 70 |
| ▶REFUSE·2·LOSE◀ | 15 | THIRD → | 60 |
| PAINT SWAPPER | 10 | FOURTH → | 50 |
| WHIPLASH | 10 | FIFTH → | 40 |
| BUMP DRAFTER | 15 | SIXTH | 30 |
| CRUNCHER | 15 | SEVENTH | 20 |
| FIGHT 2the FINISH | 20 | EIGHTH | 10 |

36 40

| •RACE SCHEDULE• | Laps | •POINTS• | |
|---|---|---|---|
| ROLLING THUNDER | 20 | FIRST → | 80 |
| GEAR GRINDER | 15 | SECOND → | 70 |
| ▶REFUSE·2·LOSE◀ | 15 | THIRD → | 60 |
| PAINT SWAPPER | 10 | FOURTH → | 50 |
| WHIPLASH | 10 | FIFTH → | 40 |
| BUMP DRAFTER | 15 | SIXTH | 30 |
| CRUNCHER | 15 | SEVENTH | 20 |
| FIGHT 2the FINISH | 20 | EIGHTH | 10 |

FIG. 8

AUTO RACING (BOARD GAME)

BACKGROUND OF INVENTION

1. Field of Invention

This invention relates to board games, and more particularly to an automotive racing game including many factors which simulate the sport of automotive racing.

Due to the ever increasing popularity of automobile racing, board games which simulate automobile racing are well known in the prior art. Such automobile racing games include a game board having a track laid out with multiple lanes, a starting line, victory lane, and a winner's circle. Player position markers resembling race cars are provided with a score sheet for each player. Players may choose a position marker as desired and play alternates among the players with the quantity of each move along the track being determined by the dice or other suitable device.

For example, U.S. Pat. No. 5,114,151 discloses a race game apparatus having an oval track structure arranged with a plurality of contiguous concentric tracks whereon the players advance their respective tokens, each move being determined by a roll of the dice. A plurality of the spaces are associated with directional cards of reward and punishment to introduce an element of chance to the game.

However, such board games offer the player little in terms of strategic options which simulate the actual sport of automobile racing.

Thus, it will be appreciated that there is a need for a new and improved automotive racing game as set forth by the present invention which offers the players strategic options and strategies similar to those utilized in the sport of automobile racing.

2. Description of Related Prior Art

U.S. Pat. No. 5,114,151 to Dana D. Bergerstock discloses a race game apparatus including an oval track structure arranged with a plurality of contiguous concentric tracks, wherein the tracks each include a plurality of spaces. A plurality of these spaces are associated with directional cards of reward and punishment types to introduce an element of chance into play of the game.

U.S. Pat. No. 5,322,293 to Daniel A. Goyette discloses an auto racing game apparatus including a game board having a track laid out with multiple lanes and overlapping lane spaces, with a starting line, victory lane and winner's circle. Player position markers resembling racing cars are provided with a lap chart/score sheet for each player and a series of lap and pit cards. Play alternates among the players with the quantity of each move being determined by the dice or other suitable device.

U.S. Pat. No. 4,264,076 to Bittle J. Duncan discloses a board racing game apparatus including playing pieces and a board having arrows marked thereon forming a continuous track divided into lanes. One group of arrows provides a preferred route around the track, certain members of another group of arrows provide for lane changing on the track straightaways so that a driver may maneuver his vehicle into the race track "groove", and a third group of arrows effects movement on the track.

U.S. Pat. No. 5,308,078 to Gary Hatter discloses an auto racing board game including a game board having a simulated race course thereon with a plurality of adjacent racing grooves. Each racing groove is divided into a plurality of sequential playing spaces, with a starting position, half way point stripe, a turn four stripe and a finish line.

U.S. Pat. No. 5,114,152 to Jesse L. Rouse et al. discloses an automotive racing game including a playing board having a series of contiguous and continuous tracks, each of the tracks defined by spaces of varying lengths, wherein tokens directed throughout the tracks may switch lanes to gain access to varying length spaces to advance about the tracks.

U.S. Pat. No. 5,350,178 to A. Keith Hollar discloses a car racing board game simulating an automobile race for one or more players including a flexible game board with a first race track depicted on one side and a second, generally smaller track on the opposite side. A textured track surface enables playing cars to remain in place if the flexible game board is placed on uneven or banked support surfaces to simulate real-life tracks. Novel rules for playing require decision making and strategy, thus creating a realistic environment of racing, changing with each play of the game.

U.S. Pat. No. 5,551,698 to Robert F. Lyon discloses an auto racing board game comprising a playing board with a race track printed thereon, a track having an outer periphery with a plurality of lanes, each lane comprising a plurality of individually printed blocks, the center section of the track including a plurality of racing related printed structures formed in a variety of shapes and sizes, the game simulating a real life auto race by encouraging players to avoid the types of hazards normally found in a real race.

U.S. Pat. No. 3,044,779 to Joseph L. Hvizdash discloses an automobile racing game including a game board having an oval-shaped automobile race track printed thereon and divided into a plurality of lanes, the game simulating actual automobile racing in that many of the chance occurrences which take place during an actual race are incorporated into the game on a chance basis.

U.S. Pat. No. 4,585,232 to Lisa K. Sheppard et al. discloses an automobile board game simulating various aspects of automobile ownership and operation. The game comprises a game board subdivided into several playing paths including a path extending around the perimeter of the board with spaces representing detriment to the player and spaces representing benefit to the player, and areas spaced inwardly of the perimeter, representing home bases or towns of the players. Play variation cards corresponding to the various spaces on the board are provided to govern play according to the instructions on the cards.

U.S. Pat. No. 1,628,073 to John B. Sousa discloses a board game having a race course delineated thereon comprising a plurality of tracks merging at opposite ends thereof into a single track, game pieces representing racers, play indicators, such as dice and scoring means.

U.S. Pat. No. 3,433,483 to Lonnie T. Ellis discloses a game board apparatus having an inner and outer closed playing paths including relatively large and unequal numbers of playing positions. The inner and outer paths are color-coded in different colors. Paths connect the inner and outer paths at spaced intervals. A pair of playing markers is provided for each player and the game board includes separate start and finish positions for each player.

Finally, U.S. Pat. Des. 210,395 to William C. Royston discloses the ornamental design for a game board having a generally oval-shaped race track including a plurality of tracks thereon as shown and described.

SUMMARY OF THE INVENTION

The present invention has been developed to provide an automobile race game which simulates the sport of automobile racing by incorporating the preliminary events, strategies, and chance occurrences encountered in automobile racing.

This is accomplished by providing a game board having a generally oval-shaped race track with multiple, contiguous lanes defined by a plurality of playing spaces.

The playing pieces resembling racing cars are provided for each player and play alternates among the players with the amount of each move being determined by a roll of the dice.

A lap chart is provided which records the number of laps completed by each player and play continues until a predetermined number of laps have been completed.

Players may use blocking strategies on the race track by positioning their game piece strategically and forcing other players to drive in the outside lanes to their disadvantage.

Play is enhanced by the use of an optional die which requires a player to draw a card which may produce some advantage or set back to the player.

The present invention provides for a plurality of different races comprising varying numbers of laps in a racing schedule in the manner of a professional racing circuit. A player earns a point value corresponding to his finish place in any given race and a cumulative point total is tallied to determine the player's position in the overall point standings.

In view of the above it is an object of the present invention to provide an automobile racing game including a game board simulating an oval-shaped race track having multiple contiguous lanes thereon.

Another object of the present invention is to provide an automobile racing game wherein the playing pieces resemble racing cars which are advanced around the race track with the quantity of each move being determined by rolling a plurality of dice.

Another object of the present invention is to provide an automobile racing game which includes the use of an optional die enabling players who have fallen behind in the game to make up at least some of the difference between their position and that of the position leader of the game.

Another object of the present invention is to provide an auto racing board game which includes further chance means including the random drawing of so-called Longshot cards containing specific instructions providing for advantage or set back to the player drawing the card.

Another object of the present invention is to provide an auto racing game including score charts resembling auto racing lap charts which are used to record the number of laps completed in a given race.

Still another object of the present invention is to provide an automobile racing game wherein so-called qualifying cards are drawn by each player to determine the player's position at the starting line in a given race which strategically benefits players that occupy the inside lane.

Other objects and advantages of the present invention will become apparent and obvious from a study of the following description and the accompanying drawings which are merely illustrative of such invention.

BRIEF DESCRIPTION OF DRAWINGS

FIG. 8 is a plan view of a race schedule including indicia assigning a point value to the various finish places.

DETAILED DESCRIPTION OF THE PREFERRED EMBODIMENT

Figure 1:
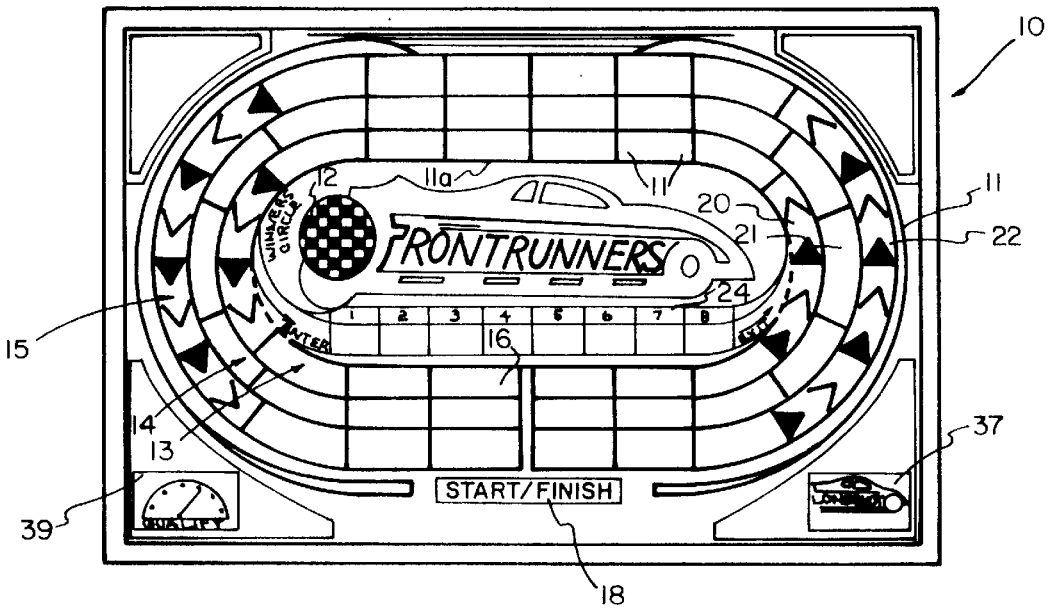
FIG. 1 is a plan view of the game board of the present invention showing an automobile race track for the play of the present game.

With further reference to the drawings, there is shown therein an automobile racing game including a game board, indicated generally at 10 and illustrated in FIG. 1.

The game board 10 of FIG. 1 includes a generally oval-shaped track 11 in the preferred embodiment. It will be understood that other track configurations having additional turns may also be used for the play of the present game. Thus, the embodiment shown in FIG. 1 is intended as merely illustrative and not restrictive in any sense.

It will be seen that track 11 comprises a plurality of contiguous lanes including an inner lane 13, at least one intermediate lane 14, and an outside lane 15.

It can be seen that each of the inner, intermediate and outside lanes 13, 14 and 15 respectively include a series of relatively short straightaway spaces 17 of equal length in the so-called straightaway section 11*a* of the track 11.

The inner lane 13 includes a series of relatively long groove spaces 20, with the intermediate lane 14 containing a larger number of groove spaces 21, and the outside lane 15 having an even larger number of groove spaces 22. For purposes of the present application, the term "groove" refers to that portion of the track 11 within the curved end portions thereof.

The exact number of groove spaces 20–22 is not critical to the play of the present game, so long as there are a sufficient number in each of the lanes 13–15 to require a number of plays to complete one lap of the track 11. However, it is critical to the present invention that the inner lane 13 have fewer spaces 20 than the intermediate lane 14, and that the intermediate lane 14 have fewer spaces 21 than the outside lane 15. Such an arrangement simulates an actual auto race track by allowing a player whose playing piece is on one of the inner groove spaces 20 to travel more quickly around the track 11 than players whose game pieces are on the intermediate or outside lanes 14–15 as occurs in actual automobile racing in the turn sections of the track.

It will also be noted that various inner groove spaces 20, intermediate groove spaces 21, and outside groove spaces 22 are staggered, with at least a small portion of their lateral limits contacting one another at every position around the track with exception of the straightaway sections 11*a* of the track 11. This permits the playing pieces to move forward, laterally to an adjacent lane having at least some contiguous boundary, and diagonally to adjacent spaces as described hereinafter in further detail.

The game board 10 includes a pit area, indicated generally at 24 having a plurality of pit stalls 25 wherein a player may be directed by drawing a card as described further below.

Figure 2:
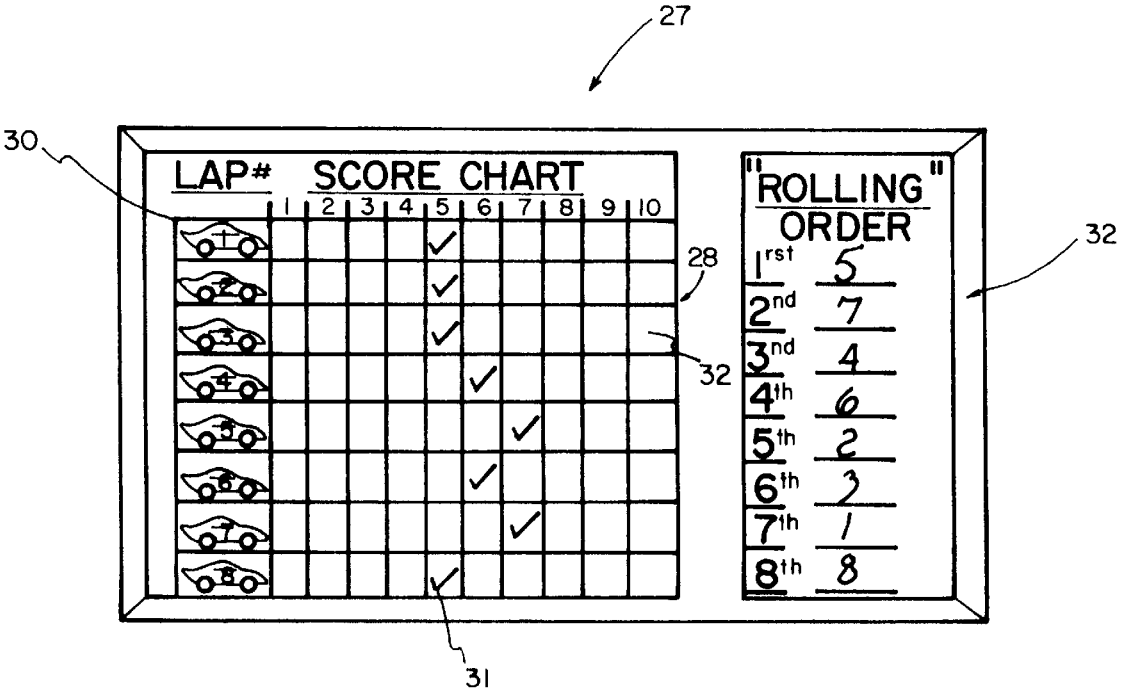
FIG. 2 is a plan view of a score chart for use in recording the number of laps completed by each player during play.

Referring now to FIG. 2 there is shown therein a score chart, indicated generally at 27 utilized in the play of the present game. The score chart 27 is similar to a lap chart used in auto racing to keep track of the position and laps completed by a given car.

Accordingly, each player in the present game is provided with a column or row 28 within the score chart 27 with each row having a space 30 for entering an individual player's name or other symbol. The score chart further includes a series of places 32 providing for the marking of laps as they are completed as indicated by check marks 31 in FIG. 2.

The score chart 27 further includes a so-called rolling order display, indicated generally at 32, which establishes the order or playing sequence in which the players roll the dice as described hereinafter in further detail.

Figure 3A:
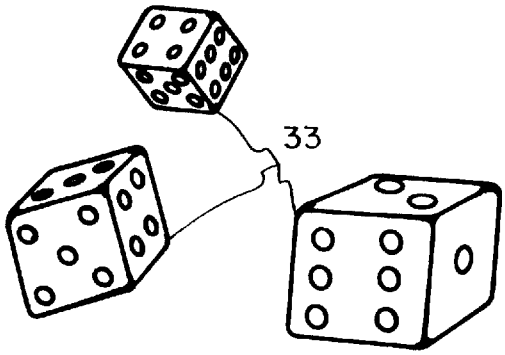
FIG. 3A is a perspective view of three standard dice which provide a form of chance means used in the play of the present game.

Referring now to FIG. 3A there are shown therein three standard dice 33 each having dots thereon representing the numbers from 1 to 6 on the various respective faces. Such dice 33 may be used to provide the chance means required for the play of the present game in combination with other chance means described further below.

Figure 3B:
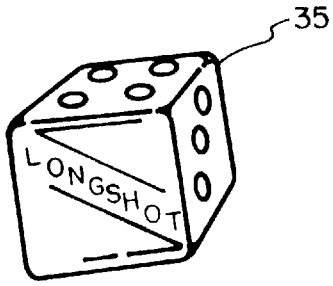
FIG. 3B is a perspective view of an optional die used in the play of the present game which introduces random advantages and setbacks to the players.

FIG. 3B illustrates an optional die 35 which provides an additional chance means for advancement or setback of player game pieces based upon the color-coded faces and other strategy elements introduced by the optional die. In particular, the optional die 35 or so-called "Chance to Advance" die adds an element of risk or strategy to the game.

The optional die 35 is designed so as to include two opposed sides being red in color, two opposed sides being green in color, and the remaining two sides being imprinted with the word "Longshot". The green colored sides of the die 35 indicate the number of spaces to be advanced in a forward direction. Conversely, the red colored sides of the die 35 indicate the number of spaces lost by the player and to be moved in the reverse direction. The sides bearing the word "Longshot" direct the player to draw a Longshot card 37.

Figure 4:
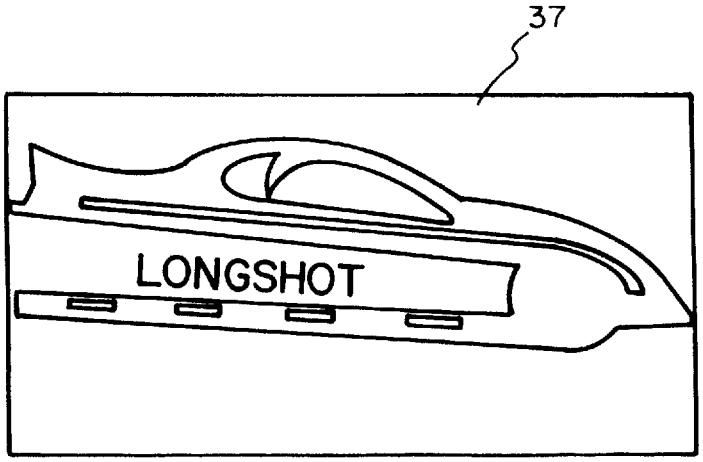
FIG. 4 is a back view of a Longshot card containing instructions to a player drawing such card during the play of the game.
Figure 5:
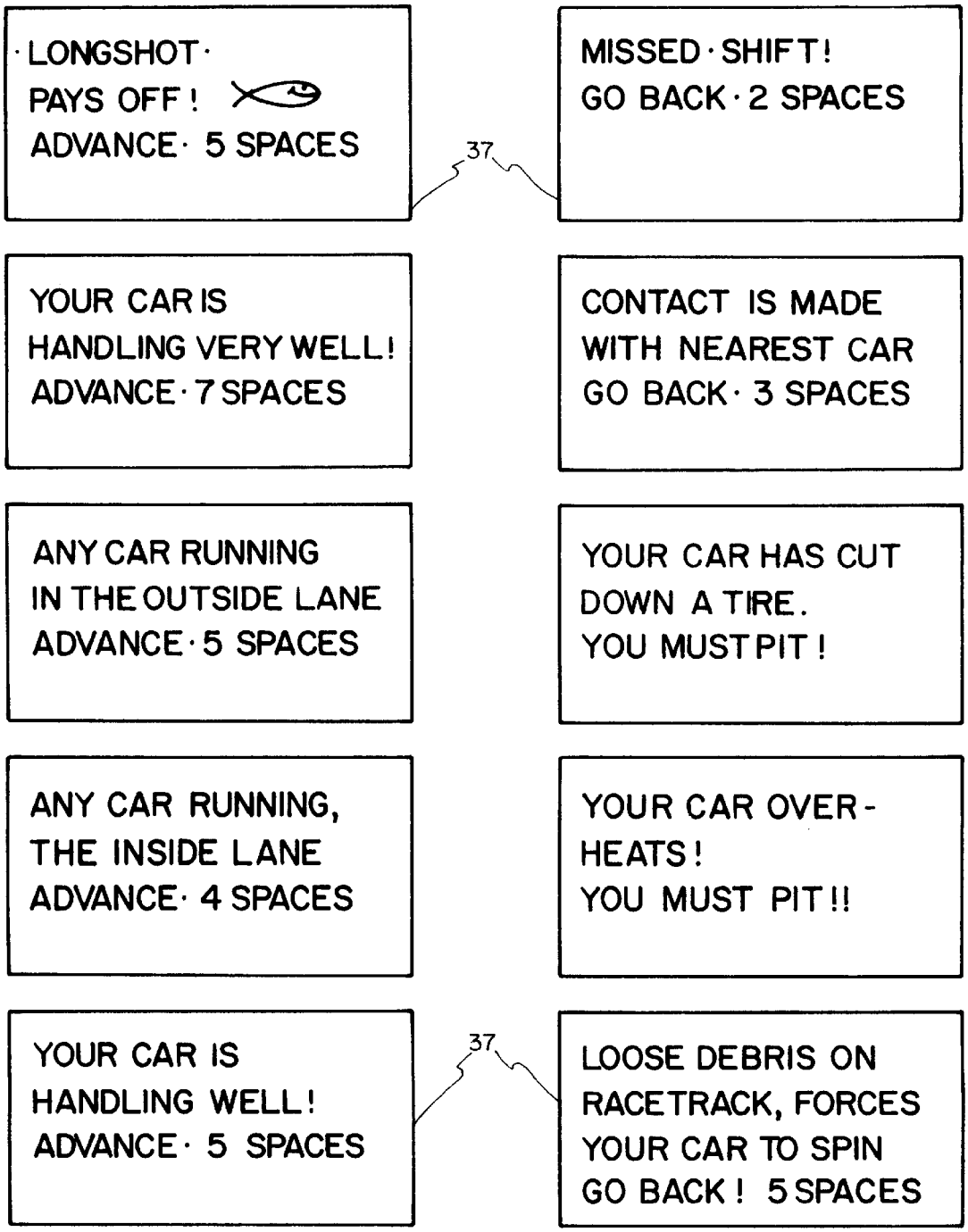
FIG. 5 is a composite front view of a plurality of Longshot cards with instructions directed to the player drawing such cards during play of the game.

Referring now to FIG. 4 there is shown therein the back face of a Longshot card 37. A plurality of these Longshot cards 37 are provided with instructions affecting the position of the player drawing such card. The content of these Longshot cards 37 is disclosed in FIG. 5.

The number of each of the above Longshot cards 37 may be varied as desired. It will be noted that these cards 37 contain a variety of instructions ranging from extremely advantageous (eg. advancing 7 additional spaces) or extremely negative circumstances (eg. being forced to enter the pit area for mechanical problems).

Figure 6:
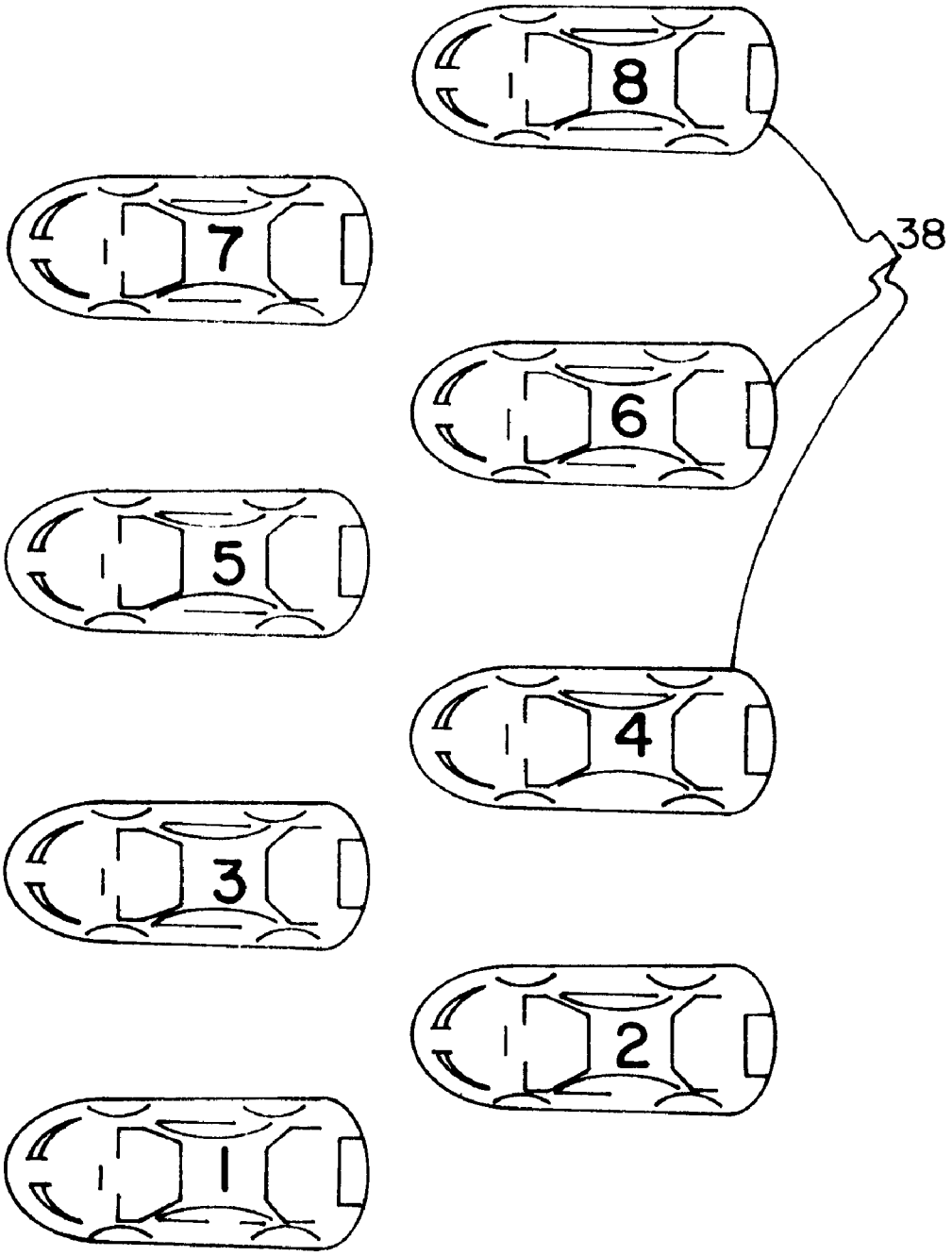
FIG. 6 is a plan view showing a plurality of player game pieces resembling race cars.

Turning now to FIG. 6 there are shown therein a plurality of typical player game pieces 38 representing an automobile for use during play of the game to mark a player's position on the track 11. Preferably a plurality of such game pieces 38 are provided with each having a different color scheme and number to represent actual racing cars.

Of course, other player game pieces may be used in the play of the present game, but the use of such game pieces 38 representing a racing car is preferred as it adds to the realism of the game. The present game is initiated by permitting the various players to choose the particular game piece 38 they wish to use in the game.

Figure 7:
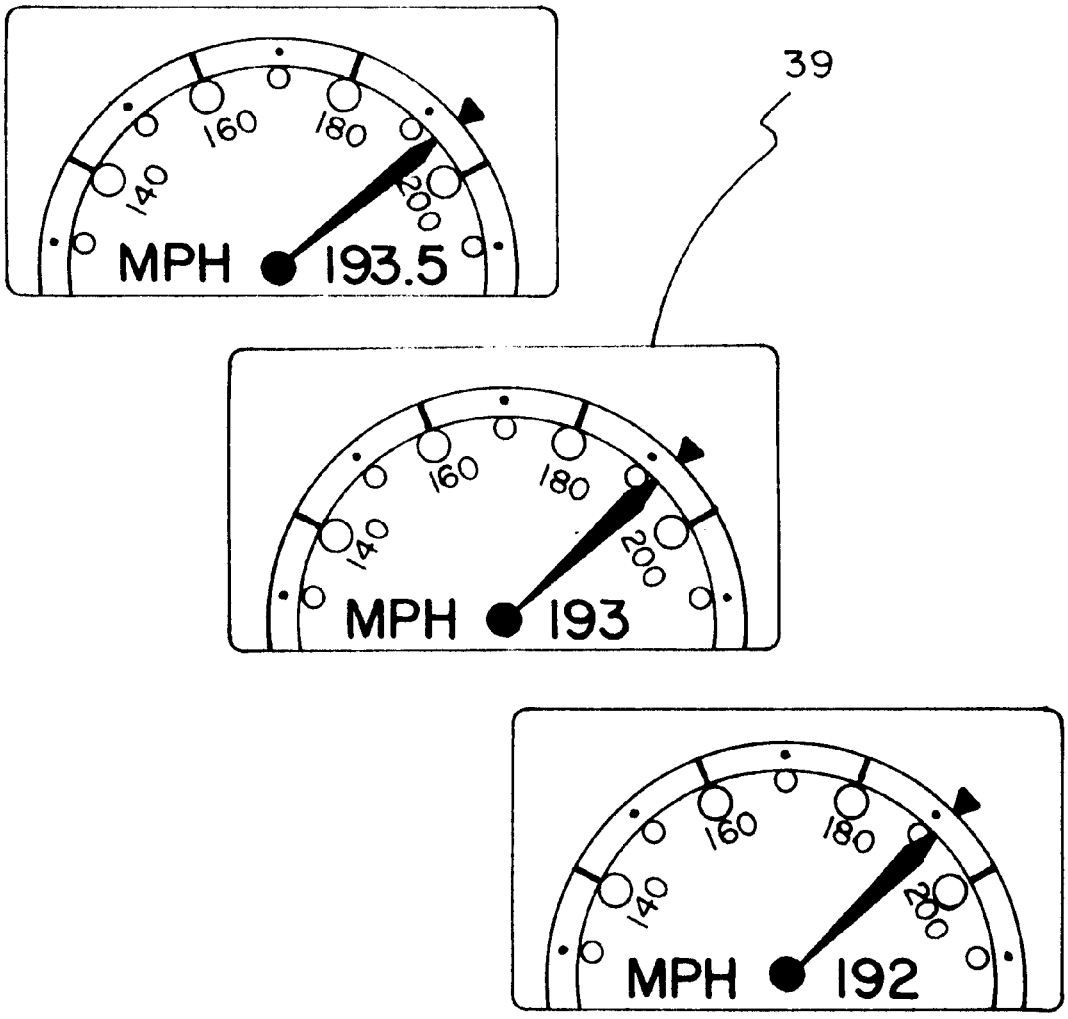
FIG. 7 is a front view of a plurality of qualifying cards utilized with the present game.

In order to qualify and determine their respective starting positions for the race, each player draws from a plurality of qualifying cards 39 as illustrated in FIG. 7. A stack of such cards 39 are positioned on the game board 10 in the lower left corner as shown in FIG. 1.

As the fastest qualifying speed is used to determine the pole position (i.e. the space closest to the starting line at the inside lane of the track) in auto racing, so the player selecting the fastest speed contained on their qualifying card 39 receives the pole position as at 16 in the present game. The player drawing the next highest qualifying speed takes the first space in the intermediate lane 14, and the next player takes the first outside lane 15 space with any subsequent players aligning their game pieces 38 in the same order behind the first spaces adjacent the starting line 18.

In the preferred embodiment qualifying cards 39 include a representation of a conventional speedometer containing indicia thereon to indicate the qualifying speed. The rolling order for the players follows the starting grid established by the qualifying cards 39.

Thus, play is begun by the player sitting at the pole position by rolling the standard dice 33 together with the optional die 35 if desired to determine the number of spaces for her move. The first player's game piece 38 is moved accordingly. The next player having the starting position closest to the starting line 18 in the intermediate lane 14 moves next and so on, with play continuing in order through each of the players before returning to the first player.

During the course of playing the game any of the players may switch lanes as there is no requirement that a player remain in the lane 13 through 15 in which the player started. Thus, it will be appreciated that a good strategy is to move to the inside lane 13 having fewer groove spaces 20 as soon as possible after the start.

Such a lane change counts as one space for the player making the move. For example, at player rolling a total of 8 with the dice 33 may move 1 space inward and 7 spaces forward in taking the inside lane 13. Of course, a player may move outwardly, if desired, since such lateral moves are necessary at times because the game pieces 38 may not be moved directly over one another during the course of play around the track 11.

It follows that it may be possible to set up move strategies to cause another player to take a longer route around another game piece 38 thus delaying that player slightly to simulate driving maneuvers in real auto racing.

One of the participating players or a non player designated by the players marks off each completed lap in the appropriate space 32 of the score chart 27.

During the course of the game, a player falling behind in the race may choose to use the optional die 35 in combination with the standard dice 33. As stated hereinabove, the optional or so-called "Chance to Advance" die 35 introduces an element of risk to the game in that a player may gain an advantage or suffer a set back depending on his roll. If the die 35 presents a green colored face, the player adds that amount to his move. If the die displays a red colored face, the player subtracts that amount from her move. Alternatively, if the die displays a so-called "Longshot" face, she will be required to draw a "Longshot" card 37 and respond according to the instructions disclosed on that card.

The card 37 may allow the player to move ahead an additional number of spaces, move back an additional number of spaces, or alternatively may require the player to enter the pit lane 24.

Whenever a player enters the pit lane 24 she suffers a disadvantage in that her progress around the track 11 is delayed causing her to fall behind in the race. Further, the blocking strategy described hereinabove can prove advantageous to other players on the track 11 if they are able to position their game pieces at the entrance or exit to the pit lane 24 as another player is entering or departing the pit lane which adds interest to the game.

Play continues as described hereinabove with the players marking off their completed laps, drawing Longshot cards, and entering the pit lane 24 as instructed. When a player has completed the predetermined number of laps in a given race according to the lap chart, that player's game piece 38 is maneuvered past the start/finish line 18 and continues to the winners circle 12. At the option of the players, this may constitute the completion of a race simulating the actual sport of auto racing wherein the first driver to cross the finish line is declared the winner and the race is over.

In the preferred method, play continues in the present game after the first player crosses the start/finish line 18 to determine the second, third, fourth and so on finishing places which receive a designated point value as indicated generally at 40 in FIG. 8.

Accordingly, the present game provides a race schedule chart 36 as set forth in FIG. 8 wherein the players may compete in multiple races over an extended time to simulate a racing season somewhat like the professional NASCAR circuit wherein the drivers compete for an overall point total and player standing.

From the above it can be seen that the present invention provides an auto racing board game which simulates the sport of auto racing.

The present game can be enjoyed by a wide variety of players from the uninitiated to dedicated fans of the sport of auto racing and employs various tactics and strategies common to real auto racing.

The present game can be played casually as a one time racing event or in the alternative, the game can be played as a series of individual racing events to simulate an auto racing schedule wherein the players receive a cumulative point total and standing.

The terms "inside", "outside", "end", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An improved board game simulating the sport of automobile racing, said game including a game board having an auto racing track thereon comprising a plurality of contiguous lanes including an inside lane, an outside lane, and at least one intermediate lane therebetween having a start/finish line extending across said lanes, said game board further including at least one pit lane and a winner's circle, a plurality of player game pieces corresponding to the number of players of said game board, at least one lap score chart having indicia thereon corresponding to the number of players of said board game, a plurality of cards providing for positional advance or setback of a player drawing one of said cards, chance means including a plurality of dice for advance of each game piece about said lanes of said track such that said board game is played by each player advancing their respective game pieces on said track according to said chance means said score chart comprising indicia for maintaining a record of their number of laps completed, players advancing each of their said game pieces to complete a predetermined number of laps to advance to said winner's circle, said improvements comprising:

supplemental chance means utilized at the option of a player in combination with said standard dice to advance a player's game piece, set back a player's game piece, and in the alternative, instruct a player to draw from among said plurality of cards and to respond to instructions contained thereon; and race scheduling means including multiple racing game events wherein a player may participate to obtain a cumulative point total to determine the overall standing of the players after completion of said race schedule.

2. The improved board game of claim 1 wherein said supplemental chance means includes a single standard die having dots representing numbers on their various faces, said die further including color coded-faces corresponding to forward and reverse movement of said game pieces on said game board.

3. The improved board game of claim 2 wherein said die further includes indicia on various respective faces thereof instructing a player to draw one of said plurality of said cards and respond to the instructions thereon.

4. The improved board game of claim 1 wherein said race scheduling means includes a score sheet comprising indicia for maintaining a record of the accumulated point totals of a player, said point totals corresponding to the position in which each player completed said racing events.

5. A method of playing a board game simulating auto racing consisting essentially of the steps of:

providing a game board having an auto racing track thereon including a plurality of contiguous lanes comprising an inside lane, an outside lane, and at least one intermediate lane therebetween with each of said lanes including a plurality of spaces, said lanes including a start/finish line extending across the plurality of lanes, at least one pit lane, at least one winner's circle, a plurality of player game pieces corresponding to the number of players of the board game, at least one score chart having indicia thereon corresponding to the number of players of said board game and for recording the number of laps completed by each player, a plurality of qualifying cards and Longshot cards providing for the starting position and for the positional advance of the player drawing one of said cards, and chance means providing for the advance of each player game piece about said lanes of said track;

assigning player game pieces to each player;

drawing a qualifying card for each player to determine the relative starting positions on said track for each player's game piece;

manipulating said chance means and placing each player's game piece accordingly on an appropriate space upon said track and marking each player's score sheet according to the number of laps completed;

supplementing said chance means by manipulating an optional die having indicia thereon which introduce random advantages and setbacks to a player;

proceeding to play in the above manner until at least one player has completed a predetermined number of laps;

advancing that player's game piece to said winner's circle of said game board;

continuing play in the above manner until all players have completed the predetermined number of laps for a given race;

assigning a point value to each player according to their finishing position in the race;

repeating the hereinabove described steps over an extended time to complete a plurality of races of different duration; and accumulating said point values achieved in each of said races to determine an overall winner.

* * * * *